United States Patent [19]

Wade et al.

[11] 4,017,259

[45] Apr. 12, 1977

[54] CELLULOSE REAGENTS INCORPORATING T-AMINO GROUPS

[75] Inventors: Clinton P. Wade, Jefferson; Stanley P. Rowland, New Orleans, both of La.

[73] Assignee: The United States of America as represented by the Secretary of Agriculture, Washington, D.C.

[22] Filed: Oct. 24, 1975

[21] Appl. No.: 625,722

[52] U.S. Cl. ..... 8/183; 8/184; 8/187; 260/482 C; 260/248 NS

[51] Int. Cl.[2] ..... D06M 13/34

[58] Field of Search ..... 8/183, 184, 187

[56] References Cited

UNITED STATES PATENTS

| | | | |
|---|---|---|---|
| 2,304,624 | 12/1942 | Burke | 260/248 |
| 3,002,859 | 10/1961 | Hurwitz | 117/143 |
| 3,512,921 | 5/1970 | Goldstein | 8/116.2 |
| 3,524,876 | 8/1970 | Gregson | 260/482 |
| 3,560,138 | 2/1971 | Spangler | 8/116.3 |

OTHER PUBLICATIONS

Textile Research Journal 44, pp. 869–874, Nov. 1974, Rowland et al.

*Primary Examiner*—John Kight, III
*Attorney, Agent, or Firm*—M. Howard Silverstein; Salvador J. Cangemi; David G. McConnell

[57] ABSTRACT

Durable press properties are imparted to cellulosic fabrics by reacting with either of two new tertiary amino-N-methylol reagents. Autocatalysis was shown by these reagents when applied as the free bases or as hydrochlorides to cotton fabric by conventional methods. Resilience, recurability, improved scorch resistance, and enhanced dye and brightener sorptions are realized.

4 Claims, No Drawings

CELLULOSE REAGENTS INCORPORATING T-AMINO GROUPS

This invention relates to new reagents and processes for the application of these reagents to cellulosic textiles. More particularly, this invention relates to t-amino-N-methylol reagents and their application in conventional pad-dry-cure processing to impart resilience, durable press properties, and increased response to acid dyes and fluorescent brighteners. The new compounds are self-catalyzed in these treatments of cotton and other cellulosic textiles and they perform suitably in the presence of conventional catalysts and when the pH of the reagent solution is lowered as far as about 1.0.

BACKGROUND AND PRIOR ART

Nitrogen-containing compounds have been extensively used in the treatment of textiles for the purpose of imparting crease resistance. Such nitrogen-containing compounds include 1-substituted-3,5-dimethylol-2,6-dihydrotriazine-4-ones, commonly referred to as dimethylol-substituted triazones.

U.S. Pat. No. 3,004,870 teaches a process for crease-proofing cellulosic fabrics by application of the substituted triazine-4-ones in the presence of a relatively mild catalyst and effecting the reaction between the triazine-4-one and the cellulose by curing at relatively high temperatures. According to that manner of treatment only low to moderate levels of wrinkle resistance and wash-wear properties are developed in the fabric. Excessive loss in tensile strength and/or abrasion resistance would occur if higher concentrations of resins were used or if the curing time and/or temperature were increased.

U.S. Pat. No. 3,512,921 teaches a process involving the same reagents but employing a pH of about 2.0 to 3.5 and a cure of about 200° to 300° F. In this process high levels of wrinkle resistance are developed.

As indicated, in the prior art, N-methylol reagents containing amino groups within the 6-membered ring, such as 1-ethyl-3,5-dimethylol-2,6-dihydrotriazine-4-one, are well known compounds and reagents for treating cellulosic fibers. The nitrogen group in this type of reagents is only very slightly basic. N-methylol reagents containing t-amino groups having basicities in the normal range expected for such amino groups have not been described in the literature. 1-(2-Dimethylaminoethyl)-2,6-dihydrotriazine-4-one is disclosed in U.S. Pat. No. 2,304,624. Various 2(dialkylaminoethyl)ethyl carbamates have been synthesized and described by Hazard et al. (Bull. Soc. Chim. France 2087 [1961]).

THE PRESENT INVENTION'S OBJECTIVES

The first object of the present invention is to provide a process for imparting to cellulosic textiles a high level of dry and wet crease resistance without causing undue degradation of the fibers of the textile.

The second object of the present invention is to provide reagents for achieving self-catalyzed reactions with cotton for development of wrinkle resistance.

A third object of the present invention is to provide a process for achieving recurability of the wrinkle-resistant fabric for the introduction of creases.

A fourth object of the present invention is to develop an increased resistance to hydrolysis in the durable press cellulosic fabric.

A fifth object of the present invention is to provide improved scorch resistance of cellulosic fabrics treated with N-methylol reagents.

Another object of the present invention is to enhance the sorption of acid dyes and fluorescent brighteners on cellulose-containing fabrics finished for the development of durable press properties.

The present invention is based on the unexpected discovery that certain reagents can be applied to cellulosic fabrics to achieve results indicated in the objectives above. It has been discovered that it is possible to use very strong acid catalysts to affect a cure without weakening the strength of the treated fabric more than commonly with conventional reagents. Crosslinking occurs under such conditions that the fabric has extremely attractive levels of dry and wet wrinkle resistance, the latter being unusually high relative to the former.

SUMMARY OF THE PRESENT INVENTION

Two tertiary-amino-N-methylol reagents, namely 2(diethylamino)ethyl N,N-di(hydroxymethyl)carbamate and dimethyloldiethylaminopropyltriazone, were prepared and shown to be useful in the wet processing of cotton and other cellulosic textiles. Autocatalysis was shown by these reagents when applied as the free base or the hydrochloride to cotton fabric by conventional pad-dry-cure techniques. The products show high resilience, recurability, improved scorch resistance, and enhanced sorption of acid dyes and acid fluorescent brighteners.

Cotton fabrics finished with the dimethylol (diethylaminoethyl carbamate) and dimethyloldiethylaminopropyltriazone — hereafter referred to as DDC and DDPT, respectively — by the mild cure process with strong acid catalysis yield strength and resilience in the finished textile in a range that is commonly realized with conventional reagents. The tert-amino groups in the DDC- and DDPT-treated cottons serve as sites for binding acid dyes and fluorescent brightening agents. A detailed description of the preparation of the DDC and DDPT can be found in Textile Research Journal, Vol. 44, No. 11, November 1974, pp 869–874; and a description of the application and evaluation of these compounds can be found in Textile Chemist and Colorist, November 1974, pp 49/251 to 51/253.

Structural configurations of the DDC and DDPT are here provided. These compounds are applicable to cellulosic fabrics in aqueous solutions of any concentration.

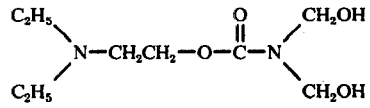

DDC

-continued

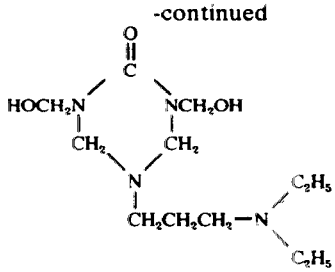

DDPT

In the application of t-amino-N-methylol reagents to cotton fabrics, the fabric is treated with aqueous solutions of DDPT or DDC in the hydrochloride or free base form. It is appropriate to store the reagents in either form. When a supplementary acid catalyst or metal salt catalyst is employed, the concentrations may be adjusted over a broad range. Softening agents and wetting agents may be added to the reagent solution. After impregnation of the reagent solution into the fabric, it may be dried with subsequent cure or it may be dried and cured in one operation. Best practice is to rinse or wash the cured fabric and to neutralize the acid catalyst, but this is not essential.

The t-amino reagents of this invention may be reacted with cellulosic fibers in the free base form or in the neutral salt form; this is essentially in the absence of conventional catalyst. These reagents may also be caused to react with cellulose in the presence of conventional metal salt or acid catalyst; the t-amino reagents tolerate a wide range of these materials in a broad range of concentrations.

The information summarized in the following examples, which deal with the chemical modification of fabrics, is based on desized, scoured, bleached 80×80 cotton printcloth in order to provide a simple illustration of effects. The same general type of results applies to other weights of fabric, to other constructions, to fabrics from other cellulosic fibers, and to fabric blends of cellulosic and synthetic fibers, primarily polyester fibers. The concentrations of reagents in pad baths can be varied over wide ranges; but to illustrate the invention, the conventional reagents have been employed at essentially their optimum concentrations and the DDC and DDPT have been employed at approximately equivalent molar concentrations as follows: DDC, 17.2%; DDPT, 15.1%; DMEC, 10%; DMET, 10.5%; and DMDHEU, 9.8%. Unless noted otherwise, the DDC and DDPT were in the hydrochloride forms (pH 6–7) as the starting point for supplementary catalysis. A wetting agent (0.5%) was employed together with a softening agent (2.0% solids) where indicated. Wet pickups were approximately 100%. In all cases, the cured fabrics were washed extensively in hot water before air drying and testing.

Efficiencies of conversion of reagent of bound residues in the treated cotton fabrics were based on nitrogen analysis by the Kjeldahl method and formaldehyde by the chromotropic acid method. Conditioned and wet wrinkle-recovery angles were measured with a standard tester by ASTM Method D-1295-67. Breaking Strength was determined by the strip (1 inch) method, ASTM Method D-1682-64. The 60-MHz nmr spectra were recorded on a standard spectrometer (a Varian A-60-A NMR Spectrometer). For specific details of the testing the reader is referred to "Two New D P Treatments from SRRC," a paper by Wade, Rowland, and Franklin, which appears in Textile Chemist and Colorist, November 1974.

The following examples are provided to illustrate the invention and should not be construed as limiting the invention in any manner whatever.

EXAMPLE 1

PREPARATION OF 2(DIETHYLAMINO)ETHYL N,N-DI(HYDROXYMETHYL)CARBAMATE

Formalin (178.0 g, 2.2 moles HCHO) was combined with 2(diethylamino)ethyl carbamate (160.2 g., 1.0 mole), and the solution (pH 10.4) was heated for 1 hour at 65° – 70° C. (Note: Calcium hydroxide may be introduced to raise pH — as in Example 2 — but this is not essential due to the basicity contributed by the t-amino group.) Then the solution was neutralized with concentrated hydrochloric acid to pH 6.8. A portion of the solution was concentrated under vacuum to a viscous syrup. The nmr spectrum (in $D_2O$) of the sirup was consistent with the dimethylol carbamate structure and showed no extraneous signals: δ1.40 (triplet, 6H, $CH_3$); δ3.39 (multiplet, 6H, C—$CH_2$—N); δ4.65 (multiplet, 2H, C—$CH_2$—O); δ4.90 (singlet, N—$CH_2$—O). The N—$CH_2$—O signal could not be integrated because it was adjacent to a strong HOD signal at δ4.95, indicating the presence of some water in the sirup.

2(Dimethylamino)ethyl N,N-di(hydroxymethyl)carbamate is prepared in the same manner by starting with 2(dimethylamino)ethyl carbamate.

The preparation of 2(diethylamino)ethyl carbamate is described in Textile Research Journal 44, pp. 869–874, November 1974 by Rowland, Wade, and Franklin. The dimethylamino analog may be prepared by the same procedure.

EXAMPLE 2

PREPARATION OF DIMETHYLOLDIETHYLAMINOPROPYLTRIAZONE

Diethylaminopropyltriazone (107.2 g, 0.5 mole) was combined with formalin solution (89.2 g, 1.1 mole HCHO), and calcium hydroxide (0.5 g) was introduced. (Note: The calcium hydroxide may be used but it is not essential.) The mixture was shaken overnight and subsequently neutralized with carbon dioxide gas and filtered. The solution was evaporated under vacuum, one portion to a viscous sirup and the remainder to a 50% solution which was neutralized to a pH 6.9 for storage. The nmr spectrum (in $CDCl_3$) of the sirup was consistent with the dimethylol triazone structure and showed no extraneous signals: δ1.00 (triplet, 6H, $CH_3$); δ1.67 (quintet, 2H, C—$CH_2$—C); δ2.52 (multiplet, 8H, C—$CH_2$N); δ4.42 singlet, 4H, N—$CH_2$—N); δ4.86 (singlet, 4H, N—$CH_2$—O); δ5.49 (singlet, 2H, OH, exchangeable with $D_2O$). Analysis: Calculated for $C_{12}H_{26}N_4O_3$: N, 20.42%. Found: N, 20.57%.

By the procedure described above, dimethyloldimethylaminopropyltriazone, dimethyloldiethylaminoethyltriazone, and dimethyloldimethylaminoethyltriazone are prepared by starting with dimethylaminopropyltriazone, diethylaminoethyltriazone, and dimethylaminoethyltriazone, respectively.

The preparation of diethylaminopropyltriazone is described in detail by Rowland, Wade, and Franklin in Textile Research Journal 44, pp. 869–874, November 1974. Other triazones may be prepared by this procedure by starting with the appropriate dialkylaminoalkylamine.

EXAMPLE 3

DDC and DDPT underwent self-catalyzed reactions with cotton when applied to fabric as the neutral hydrochlorides and subjected to a conventional pad-dry-cure reaction. Typical results are summarized in Table I and compared with the results from similar treatments with dimethylol(ethylcarbamate) (DMEC) and dimethylolethyltriazone (i.e., 1-ethyl-3,5-dimethylol-2,6-dihydrotriazone-4-one, DMET).

TABLE I

SELF-CATALYSTS OF TERT-AMINO-N-METHYLOL AGENTS WITH COTTON[a]

| Agent | Nitrogen (%) | Efficiency (%) | Wrinkle-Recovery Angle Conditioned | Wrinkle-Recovery Angle Wet |
|---|---|---|---|---|
| DDC | 0.76 | 38 | 223° | 188° |
| DMEC | trace | — | 101° | 162° |
| DDPT | 1.63 | 61 | 257° | 213° |
| DMET | 1.07 | 52 | 231° | 188° |
| None | — | — | 184° | 153° |

[a]Treatments of cotton printcloth were carried out with reagent solutions as follows: 17.2% DDC, 10% DMEC, 15.09% DDPT, and 10.5% DMET. All reagents were at pH 6–7. Fabrics padded to 90–110% pickup were dried for 5 min at 70C and cured for 3 min at 160C.

EXAMPLE 4

When conventional metal salt catalysts were used with DDC and DDPT, conditioned wrinkle recovery angles (WRA's) were generally similar to those summarized in Example 3. The results are shown as the second and third entries in Table II.

solution sodium carbonate was added to bring the pH back to the level of the free, unneutralized t-amino reagent. Cotton fabric was impregnated with this solution to a wet pickup of about 100%. One piece of fabric was dried for 5 minutes at 60° C and cured for 3 minutes and another piece was dried and cured for 7 minutes at 160° C; both samples were rinsed thoroughly in hot running tap water and dried. Analyses showed that bound nitrogen and formaldehyde were 0.68% and 0.75%, respectively, for the 3 minute cure, and 1.08% and 1.37%, respectively, for the 7 minute dry and cure.

EXAMPLE 7

With DDC in solutions adjusted to pH 1.45 with phosphoric acid and the impregnated fabric cured at 120°–180° C for 1.5 to 9 minutes, conditioned wrinkle recovery angles were about 275°. A typical example is shown in entry 7 in Table II.

EXAMPLE 8

DDC adjusted to pH 2.3 with hydrochloric acid and applied to cotton fabric with a cure at 160° C for 6 minutes resulted in wrinkle recovery angles (WRA) as shown in the 8th entry in Table II.

EXAMPLE 9

With the solution of DDC at pH 1.0 by use of hydrochloric acid, a very mild cure (85° C for 4 minutes) was sufficient to develop WRA's around 275°. These results are illustrated in entry 9 of Table II. Slightly more strenuous cures (e.g., 120° C for 3 minutes) with or without a predry at 70° for 5 minutes raised the conditioned WRA's above 290°. This is shown in entry 9 of Table II. With DDPT in solutions of low pH, WRA's of cured fabrics were similar to those treated with DDC.

TABLE II

FINISHING TREATMENTS FOR DEVELOPMENT OF RESILIENCE

| Ref. Ex. | Agent | Catalyst[a] | pH[b] | Curing Conditions | Add-on[c] % | Nitrogen[d] % | Wrinkle Recovery Angle (W+F,°) Conditioned | Wrinkle Recovery Angle (W+F,°) Wet |
|---|---|---|---|---|---|---|---|---|
| 4 | none | none | — | — | — | — | 184 | 153 |
| 4 | DDC | 0.89% Zn | | 160° C/3 min | 8.5(60) | 1.15(58) | 226 | 193 |
| 4 | DDPT | 0.89% Zn | | 160° C/3 min | 7.4(56) | 2.23(72) | 235 | 211 |
| 5 | DDC | 4.0% Zn | 5.5 | 160° C/3 min | 6.1(44) | — | 227 | 225 |
| 5 | DDC | 4.0% Mg | 6.4 | 160° C/3 min | 7.7(51) | — | 245 | 228 |
| 5 | DDC | 4.0% Mg | 4.0 | 160° C/3 min | 8.2(54) | — | 253 | 249 |
| 7 | DDC | none | 1.45 $H_3PO_4$ | 120° C/6 min[e] | 3.4(24) | — | 270 | 254 |
| 8 | DDC | none | 2.3 | 160° C/6 min[e] | 13.5(80) | — | 278 | 210 |
| 9 | DDC | none | 1.0 | 85° C/4 min[e] | 6.8(38) | 0.75(39) | 276 | 250 |
| 9 | DDC | none | 1.0 | 120° C/3 min[e] | 8.1(47) | 0.90(48) | 294 | 276 |

[a] Concentrations of metal salt catalysts are as indicated for $Zn(NO)_3.6H_2O$ and $MgCl_2.6H_2O$.
[b] Unless indicated otherwise, the pH of the treating solution was 6–7 and the acid employed was HCl.
[c] Numbers in parentheses are catalysts of apparent efficiencies of reactions of reagents with cotton based on add-ons.
[d] Values in parentheses are efficiencies of reactions of reagents based on bound nitrogen.
[e] The drying step (70° C/5 min) was omitted in these cases.

EXAMPLE 5

Magnesium chloride (4% as the hexahydrate) catalyzed the reaction of DDC with cotton more effectively than zinc nitrate. This is shown in entries 4, 5, and 6 of Table II.

EXAMPLE 6

Self-catalysis of reactions of the t-amino reagents with cotton is illustrated in the reaction of DDPT with cotton. An aqueous solution of 15 parts of DDPT was prepared from a 50% solution of DDPT stored in the form of the hydrochloride. In the preparation of this

EXAMPLE 10

Good retention of strength together with high conditioned WRA's for DDC- and DDPT-treated cottons resulted from reactions at pH 1.0 and cures at 100°–120° without intermediate drying. The values of conditioned WRA/retained strength were: DDC, 295°/45% and DDPT, 285°/44%. The corresponding values for DMDHEU-treated cotton (zinc nitrate catalysis in conventional pad-dry-cure reaction involving 160° C for 3 minutes) were 299°/42%. Additional pertinent information is summarized in Table III.

TABLE III

EFFECTS OF REAGENTS ON STRENGTH RETENTION AND RATIO OF WET/CONDITIONED WRA OF MODIFIED COTTONS

| | No Reagent WRA | | | | DMDHEU WRA | | | | DDC WRA | | | | DDPT WRA | | | |
|---|---|---|---|---|---|---|---|---|---|---|---|---|---|---|---|---|
| Cure[a] | Cond. | Wet | Rat-10[c] | Str[b] | Cond. | Wet | Rat-10[c] | Str[b] | Cond. | Wet | Rat-10[c] | Str.[b] | Cond. | Wet | Rat-10[c] | Str.[b] |
| | | | | | | Pad Solutions at pH 1.0[d] | | | | | | | | | | |
| 120/3 | — | — | — | — | — | — | — | — | — | — | — | — | 249 | 253 | 1.02 | 30.6 |
| 120/6 | 203 | 184 | 0.92 | — | 309 | 306 | 0.99 | 5.0 | 307 | 279 | 0.91 | 32.7 | 285 | 276 | 0.97 | 44.2 |
| 140/3 | 214 | 193 | 0.90 | 3.6 | 304 | 302 | 0.99 | 6.2 | 297 | 283 | 0.96 | 37.9 | 289 | 283 | 0.98 | 31.0 |
| 140/6 | 225 | 204 | 0.91 | 2.8 | 301 | 300 | 1.0 | 9.7 | 304 | 293 | 0.96 | 34.0 | | | | |
| 140/9 | 242 | 196 | 0.81 | 4.3 | 305 | 307 | 1.0 | 14.2 | 297 | 290 | 0.98 | 32.3 | | | | |
| 160/3 | 235 | 213 | 0.91 | 4.0 | 302 | 300 | 0.99 | 15.7 | 305 | 281 | 0.92 | 30.5 | 292 | 279 | 0.96 | 26.8 |
| 160/6 | 237 | 196 | 0.83 | 5.5 | 292 | 303 | 1.04 | 11.5 | 307 | 283 | 0.92 | 28.8 | | | | |
| 160/9 | 239 | 221 | 0.92 | 6.0 | 295 | 305 | 1.03 | 6.4 | 302 | 298 | 0.99 | 24.8 | | | | |
| 180/-1.5 | 240 | 223 | 0.93 | 3.9 | 291 | 301 | 1.03 | 5.9 | 306 | 285 | 0.93 | 30.7 | | | | |
| 180/3 | 245 | 228 | 0.93 | 3.9 | 285 | 294 | 1.03 | — | 302 | 289 | 0.96 | 27.9 | | | | |
| Range | | | | 3.6–6.0 | | | | 5.0–15.7 | | | | 24.8–37.9 | | | | 26.8–44.2 |
| Average | 231 | 207 | 0.90 | 4.24 | 298 | 302 | 1.01 | 9.3 | 302 | 287 | 0.95 | 31.1 | 279 | 273 | 0.98 | 33.1 |
| | | | | | | Pad Solutions at pH 2.3[d] | | | | | | | | | | |
| Range | 213–228 | 169–196 | 0.81–0.89 | .25–48 | 282–309 | 258–292 | 0.89–0.96 | 28–51 | 205–278 | 165–210 | 0.73–0.81 | — — | | | | |
| Average | 220 | 182 | 0.83 | 37 | 302 | 278 | 0.92 | 39 | 239 | 184 | 0.77 | — | | | | |

[a]The first number is degrees Centigrade and the second is the duration in minutes.
[b]Percent retained breaking strength with the original unmodified cotton at 100%.
[c]Ratio of wet WRA to conditioned WRA.
[d]All pad solutions contained 2% softener.

EXAMPLE 11

Recurability of DDC- and DDPT-treated fabrics was examined by subjecting partially cured fabrics described in Table I and fully-cured fabrics from both DDC and DDPT (cured under the conditions described in Example 9) to pressing in creased form at 160° for 30 seconds. The durability of the creases was rated after five home launderings and drying cycles. Results, which are summarized in Table IV, show that the experimental fabrics from DDC and DDPT are more active in developing durable creases than are the corresponding control fabrics treated with DMEC and DMET.

TABLE IV

CREASE RATINGS RESULTING FROM THE RECURABILITY TESTS

| Reagent | Crease Rating: Partial Cure[b] | Crease Rating: Full Cure[c] |
|---|---|---|
| DDC | 1.33 | 0.34 |
| DMEC | — | 0.00 |
| DDPT | 1.90 | 2.1 |
| DMET | — | 1.7 |
| DMDHEU | — | 1.1 |
| None | — | (1.2) |

[a]On a scale of 1 to 5, where 5 represents a good crease resulting from good recurability.
[b]Fabrics are those described in Table I.
[c]Fabrics treated with DDC and DDPT at pH 1.0 (HCl), cured 120° C/3 min; DMEC, DMET, and DMDHEU (9.8% conc.) with $Zn(NO_3)_2.6H_2O$ 0.89% conc. catalyst, cured 160° /3 min.

EXAMPLE 12

Resistance of a durable press finish on cotton to acid-catalyzed hydrolysis is readily indicated by the extent of change that occurs in WRA and nitrogen content of the fabric after strong acid treatment. Results are summarized in Table V for fully cured fabrics from DDC and DDPT (such as those described in Example 9). These results show that reagent residues from the experimental agents are more resistant to hydrolysis than the corresponding conventional agents and that the order of decreasing resistance to hydrolysis is DDC = DMDHEU > DMEC > DDPT > DMET. The resistance of DMEC- and DMDHEU-treated fabric depends upon the precise conditions under which the fabric is finished; resistance to acid-catalyzed hydrolysis was significantly lower for fabric finished to slightly lowered levels of conditioned WRA (see Table V).

TABLE V

EFFECT OF ACID HYDROLYSIS CONDITIONS UPON CROSSLINKED FABRICS[1]

| Reagent | Wrinkle Recovery Angle (W+F): Original | Hydrolyzed | Change | Nitrogen (%): Original | Hydrolyzed | Change |
|---|---|---|---|---|---|---|
| DDC | 295° | 293° | − 2° | 0.85 | 0.89 | +0.04 |
| DDPT | 285° | 234° | −51° | 1.87 | 0.40 | −1.47 |
| DMEC | 287° | 273° | −14° | 0.74 | 0.55 | −0.19 |
| DMEC[2] | 263° | 228° | −35° | 0.50 | 0.31 | −0.19 |
| DMET | 294° | 209° | −85° | 1.97 | 0.22 | −1.75 |
| DMDHEU | 299° | 299° | 0 | 1.31 | 1.26 | −0.06 |
| DMDHEU[2] | 293° | 267° | −26° | 1.13 | 0.93 | −0.20 |
| None | 182° | 186° | + 4° | 0.02 | | — |

[1]Hydrochloric acid (0.1N) for 30 min at 40° C.
[2]Fabrics treated with 8% DMEC and 0.5% $Zn(NO_3)_2.6H_2O$ or 9% DMDHEU and 0.5% $Zn(NO_3)_2.6H_2O$. The other fabrics were treated as described in Table II.

EXAMPLE 13

The resistance of DDC- and DDPT-treated fabrics to chlorine scorch is summarized in Table VI. Apparently there is little or no difference among the fully cured fabrics. However, it is significant that conventional carbamate applied by the mild cure finishing process develops substantially lower resistance to chlorine scorch than the same reagents applied in a pad-dry-cure reaction, such as shown in this table. With conventional reagents, fabrics treated by the mild cure process are generally less resistant to chlorine scorch than those treated by the pad-dry-cure process. The general indication is that DDC- and DDPT-treated fabrics finished by the mild cure process are definitely superior to fabrics treated with the corresponding conventional carbamate and triazone in the mild cure and are comparable to the fabrics treated with the latter in the pad-dry-cure process. This kind of difference is accentuated to a significant degree when fabrics treated with the conventional reagents are less fully cured or are multiple-laundered.

TABLE VI

LOSS OF BREAKING STRENGTH RESULTING FROM THE CHLORINE-SCORCH TEST

| Reagent | Strength Loss (%) |
|---|---|
| DDC | 2.5 |
| DMEC | 0.0 |
| DMEC[1] | 12.9 |
| DDPT | 5.4 |
| DMET | 6.2 |
| DMDHEU | 1.2 |
| DMDHEU[1] | 19.6 |

[1]Fabrics treated with 8% DMEC and 0.5% $Zn(NO_3)_2.6H_2O$ or 9% DMDHEU 0.5% $Zn(NO_3)_2.6H_2O$.

EXAMPLE 14

The t-amino groups in DDC- and DDPT-treated cottons serve as sites for binding acid dyes to extents that are indicated in Table VII. These dyes only stained unmodified cotton or cotton crosslinked with conventional N-methylol agents but developed good colors in the experimental fabrics. The depth of color was substantially deeper in the DDC-treated cotton than in the DDPT-treated cotton, even though the number of moles of bound reagent residues (based on nitrogen) was slightly higher for the latter crosslinked sample.

TABLE VII

COLOR DEVELOPED WITH ACID DYES

| Reagent | Acidol Orange M-RL[1] | Acid Fast Violet BG Conc. 200%[2] |
|---|---|---|
| DDC[3] | Dark | Dark |
| DDC[4] | — | Medium |
| DDPT[3] | Medium | Medium |
| DDPT[4] | — | Light |
| DMEC[3] | Light Stain[5] | — |
| DMET[3] | V. Light Stain[5] | — |
| DEAE | Medium | Medium |
| None | Trace Stain | Trace Stain |

[1]Supplied by BASF, Wyandotte Corp.
[2]C. I. Acid Blue 34, supplied by Allied Chemical Corp.
[3]Fabric as prepared by the procedure described in Table II.
[4]Fabric prepared as described by procedure in Table I.
[5]The presence of softener raised the stain to these levels from the trace level.

EXAMPLE 15

The responses of DDC- and DDPT-treated cottons to optical bleaches were greater than that of unmodified cotton. In terms of relative fluorescence, differences are shown in Table VIII, where all samples of fabric are rated relative to the unmodified cotton. Results are illustrated for fluorescent brightening agents (FBA) 30, 34, and 48, which are applied from mildly acidic media. FBA 1 applied from mildly basic media showed higher pickup and higher fluorescence on the DDC- and DDPT-treated fabrics. The same trend to higher fluorescence was shown by the experimental fabrics when they were laundered with a commercial detergent containing an FBA. As shown in Table VIII, the fluorescence developed in DDC- and DDPT-treated fabrics characterized by nitrogen contents of 0.88 and 1.87%, respectively, are often comparable to or higher than that developed in 2-diethylaminoethyl (DEAE) cotton which is not crosslinked and would be expected, therefore, to have less restricted sorption of the FBA.

TABLE VIII

RELATIVE RESPONSE OF FABRICS TO FLUORESCENT BRIGHTENING AGENTS[1]

| Reagent | Relative Fluorescence Values[2] | | |
|---|---|---|---|
| | FBA-30 | FBA-34 | FBA-48 |
| None | 1.00 | 1.00 | 1.00 |
| DDC | 2.60 | 1.25 | 9.5 |
| DDPT | 1.70 | 1.48 | 1.92 |
| DMEC | 0.70 | 0.58 | 0.88 |
| DMET | 1.20 | 0.80 | 0.86 |
| DMDHEU | 0.45 | 0.40 | 0.96 |
| DEAE | 1.85 | 1.45 | 1.97 |

[1]The following fluorescent brightening agents were used: FBA-30 (Blencopher R) recommended for cellulosic fabrics, molecular weight 642; FBA-34 (Leucophor B conc.) recommended for wool and nylon, molecular weight 766; FBA- 48 (Ultraphor WI) recommended for nylon and wool, molecular weight 440.
[2]Normalized to fluorescence value of the unmodified control fabric with each FBA.

EXAMPLE 16

For cotton fabric finished with DDC and DDPT in mild cures with strong acid (e.g., HCl, pH 1.0), levels of conditioned and wet WRA's were high; the ratios of wet to conditioned WRA's for these fabrics averaged 0.95 and 0.98, respectively. These ratios were higher for fabrics treated at pH 1 than for those treated at pH 2.3, as summarized in Table III. These results show that the treating solution of lower pH gives rise to a higher ratio of wet to conditioned WRA.

We claim:

1. A process for imparting to cellulosic fabric durable press properties, recurability, resistance to hydrolysis, scorch resistance, and sorption of acid dyes and fluorescent brighteners comprising reacting a cellulosic fabric with an aqueous tertiary-amino-N-methylol reagent selected from the group consisting of 2(diethylamino)ethyl N,N-di(hydroxymethyl)carbamate and dimethyloldiethylaminopropyltriazone in the presence or absence of metal salt or acid catalysts.

2. A process for imparting to cellulosic fabric durable press properties, recurability, resistance to hydrolysis, scorch resistance, and sorption of acid dyes and fluorescent brighteners, the process comprising:

a. impregnating a cellulosic fabric with an aqueous solution containing about 1 to 25% of a tertiary-amino-N-methylol reagent selected from the group consisting of 2(diethylamino)ethyl N,N-di(hydroxymethyl)carbamate, and dimethyloldiethyl-aminopropyltriazone, and b. curing the wet impregnated fabric from a few seconds to several minutes at about from 80° to 180° C.

3. The process of claim 2 wherein the methylol reagent is 2(diethylamino)ethyl N,N-di(hydroxymethyl)-carbamate.

4. The process of claim 2 wherein the methylol reagent is dimethyloldiethylaminopropyltriazone.

* * * * *